US005513667A

United States Patent [19]

Usher

[11] Patent Number: 5,513,667

[45] Date of Patent: May 7, 1996

[54] PARTS WASHING APPARATUS

[76] Inventor: Michael D. Usher, 5840 Swan Lake Ct., West Bloomfield, Mich. 48322

[21] Appl. No.: 348,716

[22] Filed: Dec. 2, 1994

[51] Int. Cl.[6] ..... B08B 3/02

[52] U.S. Cl. ..... 134/111; 134/174; 134/186; 134/191; 134/198

[58] Field of Search ..... 134/104.2, 104.4, 134/111, 174, 186, 198, 199, 200, 191

[56] References Cited

U.S. PATENT DOCUMENTS

| | | | |
|---|---|---|---|
| 1,714,324 | 5/1929 | Smith | 134/174 |
| 3,393,689 | 7/1968 | Faler | 134/104.4 |
| 3,522,714 | 8/1970 | Olson | 134/111 |
| 4,462,415 | 7/1984 | Otzen | 134/111 |
| 5,265,633 | 11/1993 | Knowlton | 134/135 |
| 5,322,078 | 6/1994 | Tuttle | 134/104.4 |

FOREIGN PATENT DOCUMENTS

| | | | |
|---|---|---|---|
| 2203813 | 10/1988 | United Kingdom | 134/111 |

*Primary Examiner*—Philip R. Coe
*Attorney, Agent, or Firm*—Brooks & Kushman

[57] ABSTRACT

A parts washer unit including a cleaning fluid storage receptacle which can be easily interchanged or exchanged with a like receptacle by the user of the unit. The unit includes a sink secured to the top of a support frame that defines a space accommodating the receptacle. The sink includes a drain opening which is aligned with an opening on one end of the receptacle when the receptacle is in place beneath the sink. A conveyor is secured to the frame which permits the receptacle to be readily transported to and from the desired location beneath the sink drain opening. A fluid circulating system includes a pump, a bag strainer, and hoses which extend in use into the sink for directing fluid over parts to be washed. When a new supply of cleaning fluid is required, the receptacle containing the contaminated fluid is easily removed from the space defined by the sink support frame and replaced by a new receptacle containing fresh fluid.

5 Claims, 3 Drawing Sheets

PARTS WASHING APPARATUS

TECHNICAL FIELD

This invention relates to parts washing apparatus and more particularly to a parts washer that is readily serviceable by the end user.

BACKGROUND ART

Parts washers or cleaners have been used by mechanics at auto dealerships, garages and other places of business for many years. U.S. Pat. No. 3,702,814 discloses a typical prior art parts washer comprising a sink mounted to a fluid storage receptacle that provides support for the sink and contains the fluid used to clean the parts. In order to service the parts washer the sink must be removed from the old receptacle and mounted to a new receptacle. Since the sink may contain heavy parts, they must first be removed, otherwise servicing is difficult and handling may be hazardous. Moreover, the configuration shown in the patent tends to be relatively unstable particularly when heavy parts are placed in the sink.

SUMMARY OF THE INVENTION

In view of the above, it is a primary object of the present invention to provide a parts washer that is readily serviceable and offers increased stability.

In accordance with the present invention a parts washer is proposed that includes a sink that is mounted to an independent support structure that is adapted to receive and support the fluid storage receptacle. The sink support structure includes a roller conveyor that supports the receptacle and permits an old receptacle to be easily replaced with a new receptacle without involving the sink during servicing of the washer. A fluid circulating system includes a submersible electric pump located in the fluid receptacle for circulating cleaning fluid between the receptacle and the sink. The cleaning fluid is preferably an aqueous solution and a suitable heating unit is provided to elevate the temperature of the solution to improve its cleaning capabilities.

BRIEF DESCRIPTION OF THE DRAWINGS

A more complete understanding of the present invention may be had from the following detailed description which should be read in conjunction with the drawings in which.

DETAILED DESCRIPTION OF PREFERRED EMBODIMENT

Figure 2:
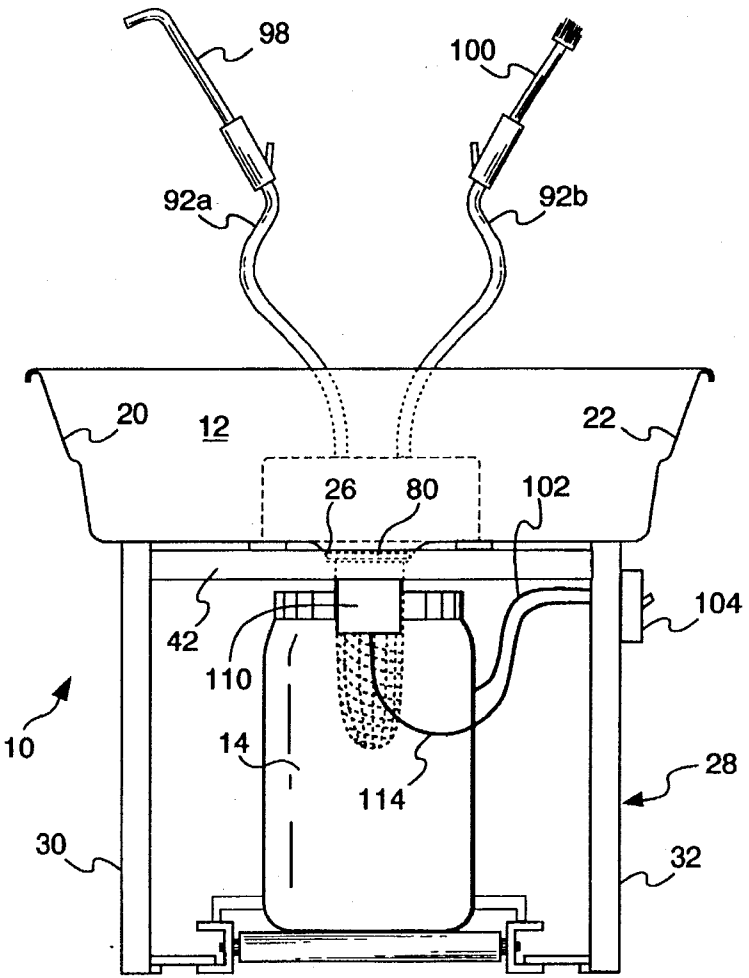
FIG. 2 is side elevation view of the parts washer of the present invention.
Figure 1:
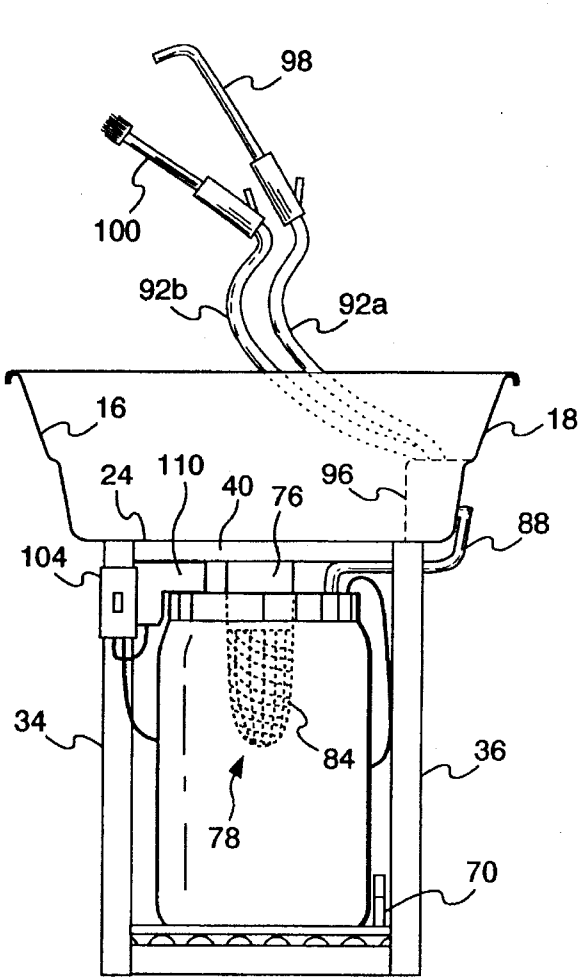
FIG. 1 is front elevation view of the parts washer of the present invention.

Referring now to the drawings, and initially to FIGS. 1 and 2, the parts washing apparatus of the present invention is generally designated 10 and includes a sink 12 for holding parts to be cleaned. The solution for cleaning the parts is stored in a generally barrel shaped polyethylene receptacle 14. The cleaning solution is preferably a water based alkaline detergent or similar biodegradable washing solution. The sink 12 includes front and rear walls 16 and 18, side walls 20 and 22 and a bottom wall 24 forming an enclosure for receiving and holding the parts to be cleaned. The bottom wall 24 has a centrally located drain opening 26. The sink 12 is supported on a metal stand or support frame generally designated 28 that is intended to rest on a work surface, not shown. The frame includes four legs 30–36 formed by steel angle members.

Figure 3:
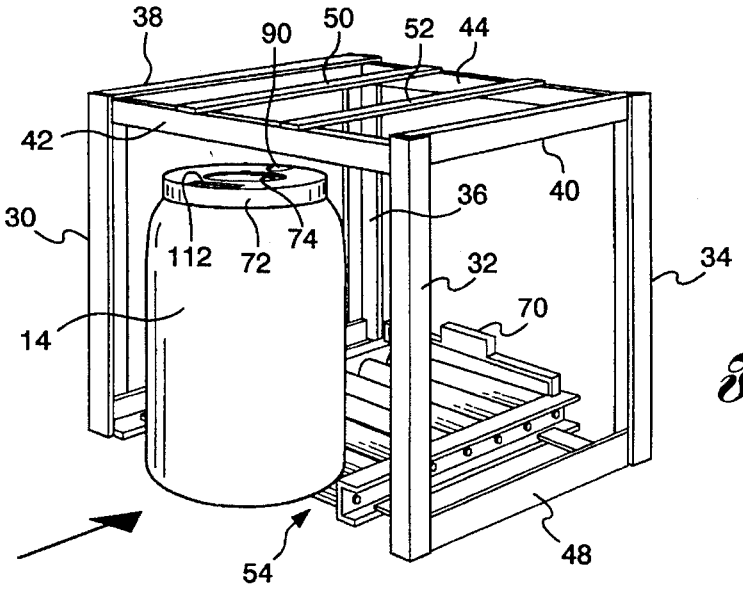
FIG. 3 is a perspective view of the parts washer of the present invention with the sink removed to show the frame for supporting the sink and fluid receptacle.
Figure 4:
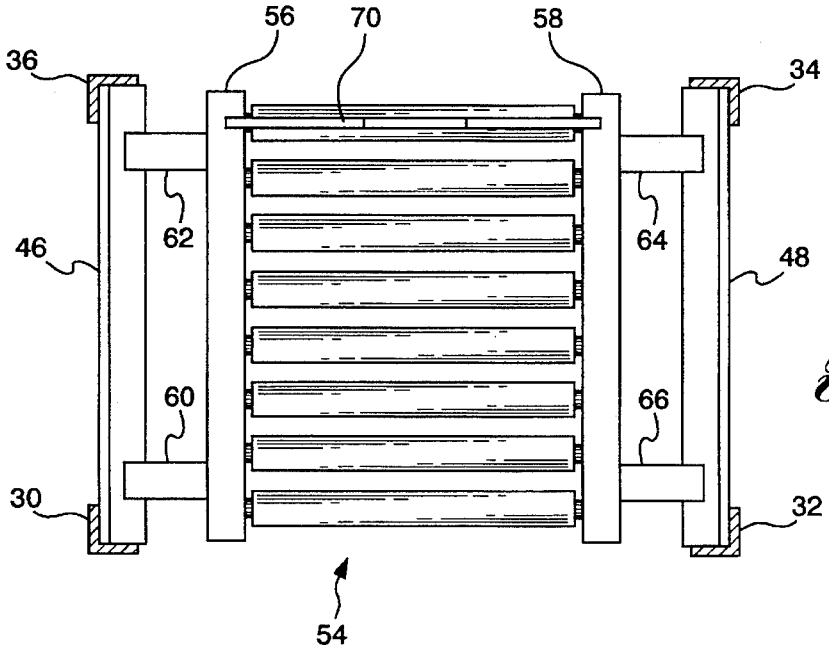
FIGS. 4 and 5 are top and front elevation views respectively showing details of assembly of the roller conveyor to the frame.
Figure 5:
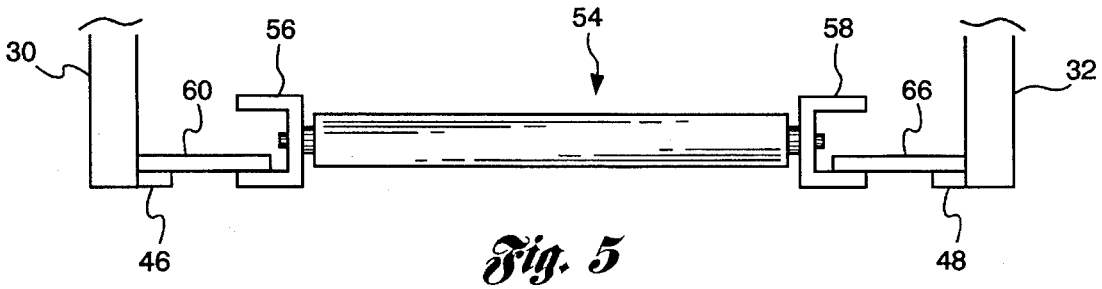
Figure 6:
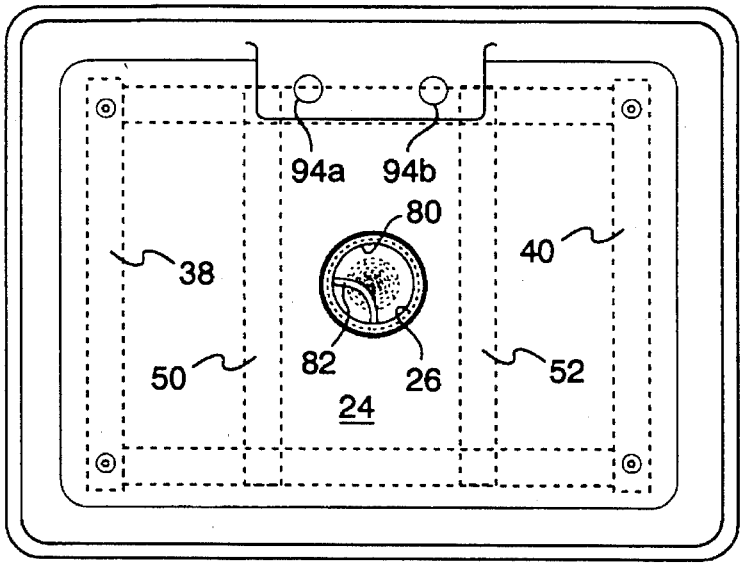
FIG. 6 is a top view of the parts washer of the present invention.

With further reference to FIGS. 3–5, the legs 30 and 36 are welded to an upper left steel angle member 38, while the legs 32 and 34 are welded to an upper right steel angle member 40. The front legs 30 and 32 are welded to a front steel angle member 42, while the rear legs 34 and 36 are welded to a rear steel angle member 44. Lower left and right steel angle members 46 and 48 are welded to the legs 30,36 and 32,34 respectively. The sink 12 is attached by suitable fasteners to the members 38 and 40 as shown in FIG. 6. Additional upper structural members 50 and 52 bridge the members 42 and 44 to provide support for the sink 12. A light duty gravity roller conveyor generally designated 54 includes a plurality of rollers rotatably supported by channel brackets 56 and 58. Bridging members 60 and 62 are secured to the member 46 and the bracket 56 by welding or other means. Bridging members 64 and 66 are similarly secured to the member 48 and bracket 58. A stop 70 is suitably secured, as by welding, to the brackets 56 and 58 and serves to locate the receptacle 14 beneath the drain opening in the sink. The receptacle 14 has a cover 72 with a central opening 74 that is aligned with drain opening 26 when the receptacle is in place beneath the sink 12.

A sock strainer and splash guard, generally designated 78, seats in the drain opening 26 in the sink and extend through the central opening 74 of receptacle cover 72 and into the receptacle 14. The strainer 78 serves as a filter by collecting relatively large particles that are removed from the parts during the cleaning process. As shown in FIG. 6, the strainer 78 includes an annular rim portion 80 formed of a suitable plastic material which rests on an annular support ridge formed in the drain in the bottom of the sink 12. The rim 80 includes an integrally formed handle 82 to permit easy removal of the strainer from the sink. A mesh portion 84 of the stainer joined to the rim portion 80 may be suitably treated, for example, by painting an area of the mesh portion extending from the rim portion 80 into the receptacle 14 to form a splash guard generally indicated at 76 in FIG. 2. Alternatively, the plastic material forming the rim portion 80 may extends downwardly from the rim and join with the mesh portion below the opening in the receptacle cover 72.

Figure 7:
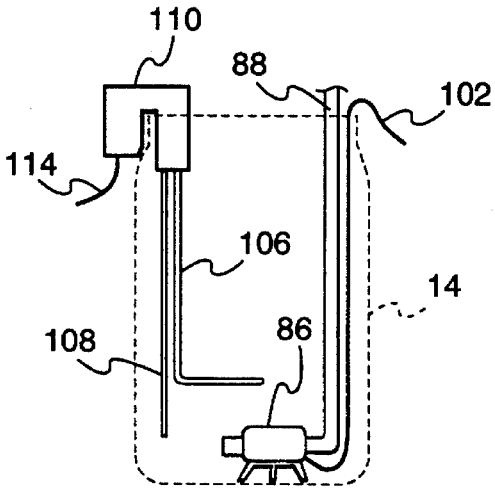
FIG. 7 shows the fluid receptacle in outline showing the removable pump and heater assemblies.

With reference to FIG. 7, a system for circulating fluid from the receptacle 14 to the sink 12, includes a submersible pump and electric motor unit 86 suitably situated in the cleaning solution. The pump 86 is connected with a flexible outlet tube 88 that extends through a cutout portion 90 of the receptacle cover 72, see FIG. 3. The tube 88 branches to two separate flexible interconnected portions 92*a* and 92*b* that extend through respective openings 94*a* and 94*b* in an integrally formed generally rectangular shaped cavity portion 96 of the sink 12. Preferably, the portions 92*a* and 92*b* include respective manually operated valves for controlling the flow of fluid. The flexible conduit portions 92*a* and 92*b* are respectively coupled to a flexible nozzle 98 and a brush end 100 to deliver solution to the parts located in the sink 12 under hand control of the user. The pump 86 is suitably connected to a power outlet (not shown) through an electrical conductor 102 and a control switch on a switch box generally designated 104.

A heater element 106 and heat sensor 108 are suitably mounted in a collar 110 that extends through a cutout portion 112 of the receptacle cover 72 and is fitted over the rim of the receptacle 14. The element 106 and sensor 108 are suitably electrically connected to the power outlet through conductor(s) 114 and maintains a relatively constant solution temperature elevated sufficiently to improve the cleaning ability of the solution, as is well known in the art.

When servicing is required, the strainer 78 is removed from the sink 14 and the receptacle containing the contaminated fluid is moved forward on the conveyor 54 and removed from the space created by the support frame 28. The pump and heater assemblies are removed from the receptacle and placed in a new receptacle with clean fluid. The new receptacle 14 is placed by the user on the conveyor 54 and moved rearwardly against the stop 70 to position the receptacle in the space vacated by the old receptacle. Although a full receptacle weighs approximately one hundred and thirty pounds, it is a relatively easy task for the parts washer user to place the receptacle on the conveyor and thereafter move the receptacle to its final location beneath the sink drain.

It will be understood that the above description of the preferred embodiment is by way of example only and that various modifications are possible without departing from the spirit and the scope of the present invention as hereinafter claimed.

What is claimed is:

1. A readily serviceable parts washer comprising, in combination, a sink for receiving parts to be washed, said sink including a bottom wall having a drain opening, a support structure for said sink, said support structure defining a space beneath said bottom wall for accommodating a cleaning solution storage receptacle in substantially vertical alignment with said drain opening, and a pump system for circulating solution between said receptacle and said sink, a conveyor secured to said support structure and resting on a work surface for transporting the receptacle during removal from and inserting into said space, said receptacle containing cleaning solution during both insertion into and removal from said space.

2. A readily serviceable parts washer comprising, in combination, a sink for receiving parts to be washed, said sink including a bottom wall having a drain opening, a storage receptacle for storing a cleaning solution, a support structure for said sink resting on a flat work surface, said support structure defining a space beneath said bottom wall for accommodating said storage receptacle in substantial vertical alignment with said drain opening, said receptacle having a receptacle opening aligned with said drain opening, when said receptacle is located in said space, a conveyor secured to said support structure and resting on said work surface for transporting the receptacle during removal from and inserting into said space, said receptacle containing solution during both insertion and removal from said space, a pump system for transferring solution from said receptacle to said sink with the fluid returning to said receptacle though said drain opening, and a filter interposed in the path of fluid returning from said sink to said receptacle, said support structure being a generally rectangular metal frame for supporting said sink at a height above said work surface sufficient to accommodate said receptacle, said conveyor comprising a plurality of longitudinally extending rollers for transporting said receptacle, said receptacle being a drum having one end portion supported by said conveyor and an opposite end portion including said receptacle opening, said conveyor having stop means for locating said drum so that said receptacle opening is aligned with said drain opening.

3. The parts washer of claim 2 wherein said receptacle receives a portion of said pump system including a pump and motor for drawing fluid from said receptacle, said pump system further including at least one fluid conduit for directing said fluid toward the parts to be washed, said filter including an upper portion removably supported in said drain opening to receive fluid exiting said drain opening and to direct fluid to a lower portion located within said receptacle.

4. The parts washer of claim 2 wherein said cleaning fluid is an aqueous solution, and said fluid circulating system includes means for controlling the temperature of the solution.

5. Parts washing apparatus comprising in combination, a sink for receiving parts to be washed, said sink including a bottom wall having a drain opening, a support structure for said sink, said support structure defining a space beneath said bottom wall for accommodating a cleaning solution storage receptacle in substantial vertical alignment with said drain opening, a conveyor secured to said support structure and resting on a work surface for transporting the receptacle during removal from and inserting into said space, said receptacle including a receptacle opening and containing solution during both insertion and removal from said space, said conveyor including stop means for aligning said receptacle opening with said drain opening during insertion into said space.

* * * * *